United States Patent [19]

Kato

[11] Patent Number: 4,884,433

[45] Date of Patent: Dec. 5, 1989

[54] PRESS APPARATUS FOR SMALL PRECISION PART

[75] Inventor: Heizaburou Kato, Shizuoka, Japan

[73] Assignee: Sankyo Manufacturing Company, Ltd., Japan

[21] Appl. No.: 178,698

[22] Filed: Apr. 7, 1988

Related U.S. Application Data

[63] Continuation of Ser. No. 7,236, Jan. 27, 1987, Pat. No. 4,761,988.

[30] Foreign Application Priority Data

Jan. 28, 1986 [JP] Japan ..... 61-16335

[51] Int. Cl.[4] ..... B21J 13/00

[52] U.S. Cl. ..... 72/446; 72/452; 100/282

[58] Field of Search ..... 72/441, 446, 448, 454, 72/457; 100/282, 292

[56] References Cited

U.S. PATENT DOCUMENTS 3,908,436 9/1975 Bothe ..... 72/446
3,929,000 12/1975 Kralowetz ..... 72/454

FOREIGN PATENT DOCUMENTS 1627965 5/1971 Fed. Rep. of Germany .
543377 12/1973 Switzerland .
171745 11/1921 United Kingdom .

OTHER PUBLICATIONS

"Cams, Design, Dynamics, and Accurary" Harold A. Rothbart, 1956, pp. 324–329.
Periodical: *Werkstatttechnik* 57, 1967, vol. 5, Ill. 11 on p. 235.
Kinematik/Getriebelehre; H. J. Knab, 1930, p. 1793, Figs. 533, 535, 536.

*Primary Examiner*—David Jones
*Attorney, Agent, or Firm*—Pollock, Vande Sande & Priddy

[57] ABSTRACT

A press apparatus having a crank shaft mounted in a crown and having at least one crank portion, and first, second and third roller followers which are fitted on the crank portion to be rotatable about the axis of the crank portion eccentric with the rotational axis of the crank shaft and which are disposed parallel with each other in the axial direction of the crank portion in positions corresponding to the left and right ends and an intermediate section of the crank portion. The apparatus also has a slide post which is disposed in the crown to be slidable in the vertical direction and which is connected at the lower end to a slide, and upper and lower roller pads disposed in the slide post and respectively having a pressure-contact surface which pressingly contacts the first and second roller followers and a pressure-contact surface which pressingly contacts the third roller follower. As the crank shaft rotates, the vertical movement of the slide post is generated by the eccentric rotary motion of the first, second and third roller followers. The radius of this rotary motion is defined by the distance between the rotational axis of the crank shaft and the axis of the crank portion. The apparatus contains a shut height adjustment mechanism which includes a rotatable eccentric flange which supports the crank shaft in the press, whereby rotational movement of the flange moves the crank shaft vertically, thus changing the shut height.

2 Claims, 6 Drawing Sheets

PRESS APPARATUS FOR SMALL PRECISION PART

This is a continuation of application Ser. No. 007,236, filed Jan. 27, 1987, now U.S. Pat. No. 4,761,988.

BACKGROUND OF THE INVENTION

1. Field of the Invention

The present invention relates to a press apparatus suitable for manufacturing small-size precision parts such as electronic parts.

2. Description of the Prior Art

One press apparatus of this type has been known, which employs an arrangement in which a crank shaft and a side post are connected to each other through a connecting rod and the rotary motion of the crank shaft is converted into the vertical motion of the slide post, that is, a so-called crank mechanism, thereby moving a slide which is fixed to the lower end of the slide post in the vertical direction.

Conventional apparatus having this type of crank mechanism necessitate provision of bearings which are disposed at the connection between the connecting rod and the crank shaft and at the connection between the connecting rod and the slide post. However, the performance of this apparatus is not satisfactory in the manufacture of small-size precision parts which must be worked with a high-degree of accuracy because these bearing portions tend to generate certain amount of play and because the vertical reciprocating motion of the slide post generated by the crank mechanism cannot be obtained as a movement representative of a perfect sine curve.

SUMMARY OF THE INVENTION

Therefore, an object of the present invention is to solve the problems of the prior art, and the present invention provides a press apparatus comprising: a crank shaft mounted in a crown and having at least one crank portion; first, second and third roller followers which are fitted on the crank portion to be rotatable about the axis of the crank portion eccentric with the rotational axis of the crank shaft and which are disposed parallel with each other in the direction of the axis of the crank portion in positions corresponding to the left and right ends and an intermediate section of the crank portion; a slide post disposed in the crown to be slidable in the vertical direction and connected at the lower end to a slide; and upper and lower roller pads respectively having a pressure-contact surface pressingly in contact with the first and second roller followers and a pressure-contact surface pressingly in contact with the third roller follower, wherein, when the crank shaft is driven and rotated, the vertical movement of the slide post is generated by the eccentric rotary motion of the first, second and third roller followers the radius of which is defined by the distance between the rotational axis of the crank shaft and the axis of the crank portion.

In this arrangement of the press apparatus in accordance with the present invention, the rotary motion of the crank shaft is converted through the eccentric rotary motion of the first, second and third roller followers into the vertical motion of the slide post. The crank shaft, the first, second and third roller followers and the slide post constitute a mechanism which is generally known as a yoke mechanism or yoke cam mechanism. The yoke mechanism in this apparatus functions to generate the vertical motion of the slide post and the slide connected to the slide post.

DESCRIPTION OF THE PREFERRED EMBODIMENT

An embodiment of the present invention will be described below with reference to the accompanying drawings.

Figure 1:
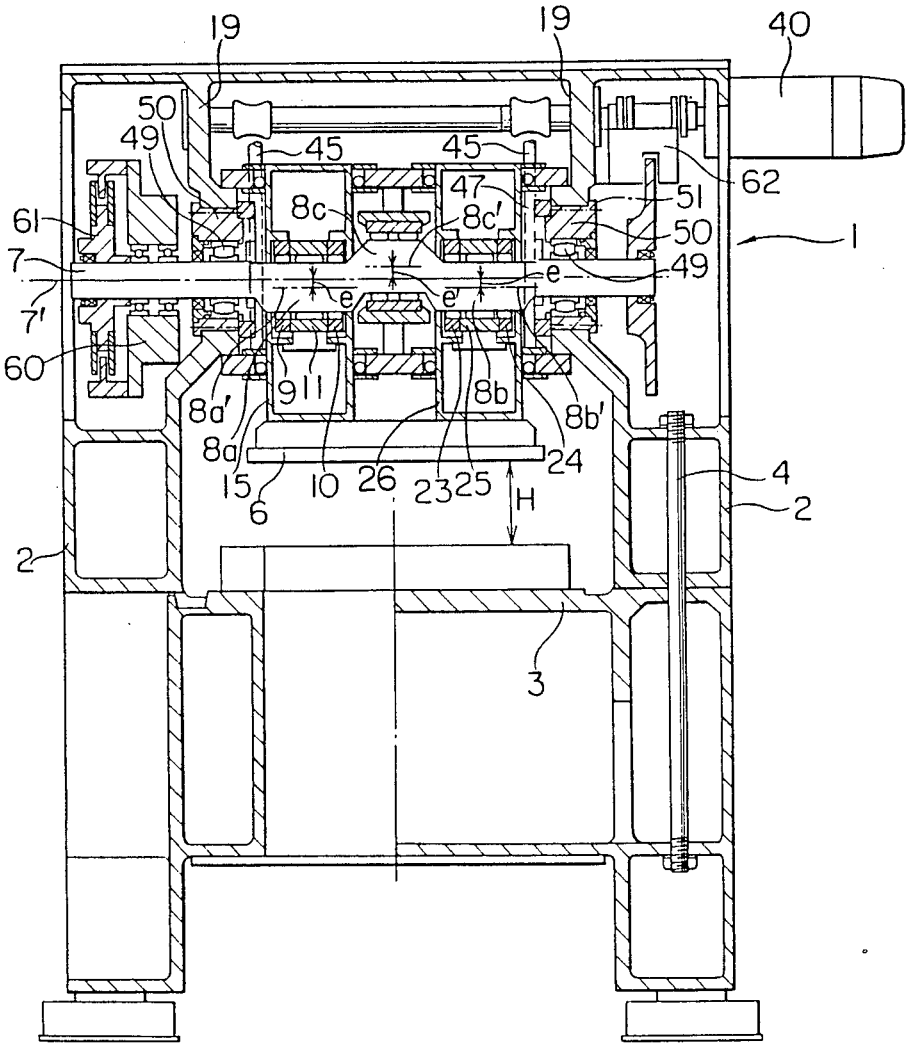
FIG. 1 is a longitudinal sectional view of a press apparatus which represents an embodiment of the present invention.
Figure 2:
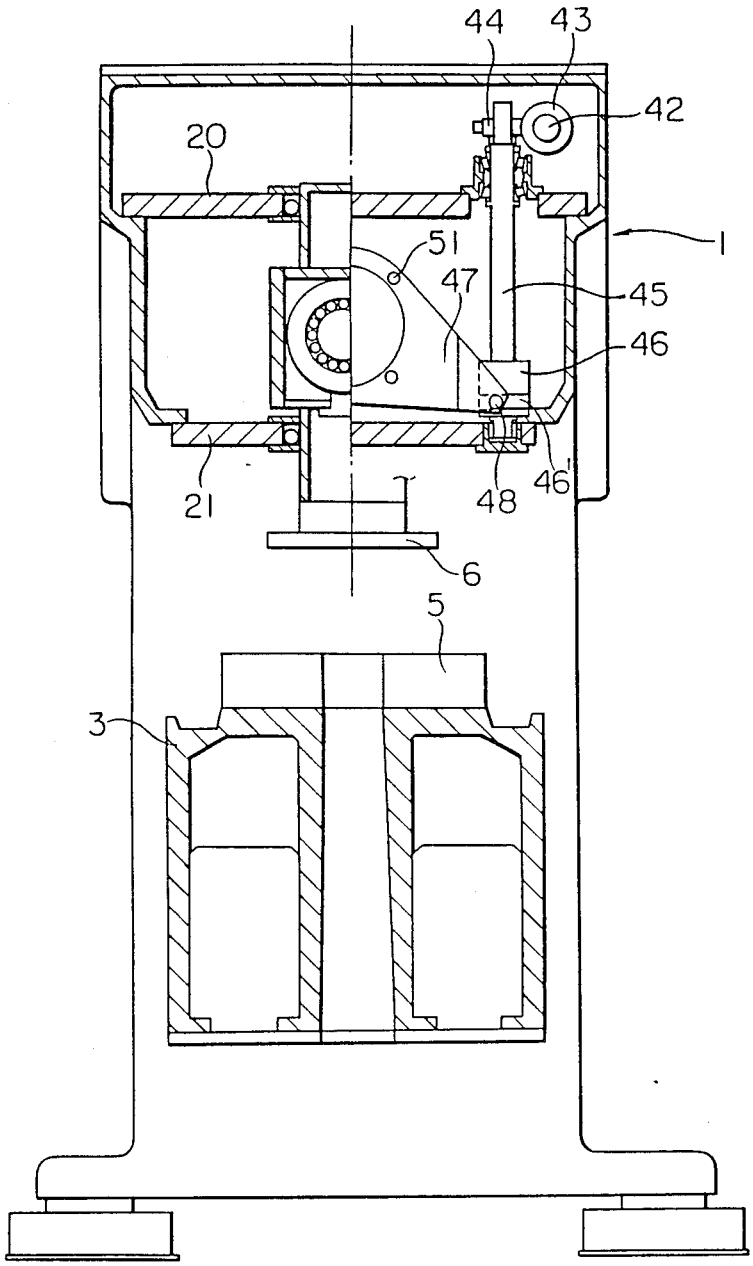
FIG. 2 is a partial sectional side view of the apparatus shown in FIG. 1.

As is clear from FIGS. 1 and 2, a press apparatus which represents the embodiment shown in the drawings has a crown 1, uprights 2 integrally formed under the crown 1, and a bed 3 disposed under the crown and the uprights. The uprights 2 are fixed to the bed 3 by means of tie rods 4. A bolster plate 5 is secured on the bed 3, and a slide 6 is disposed such as to be movable in the vertical direction. Male and female dies (not shown) are respectively secured on the lower surface of the slide 6 and the upper surface of the bolster plate 5. As the slide 6 is moved from the top dead center as shown in FIG. 4 to the bottom dead center as shown in FIG. 1, a workpiece is worked between the upper and lower dies.

A crank shaft 7 is mounted in the crown 1 such as to be rotatable about the rotational axis 7'. As shown in FIG. 1, this crank shaft 7 has a central crank portion **8*c* with an axis 8*c'* offset (in the upward direction as viewed in FIG. 1) from the rotational axis 7' by a distance e', and crank portions 8*a* and 8*b* disposed on the left and right hand sides of the central crank portion 8*c* and having axes 8*a'* and 8*b'* oppositely offset (downwardly as viewed in FIG. 1**) by a distance e.

Figure 4:
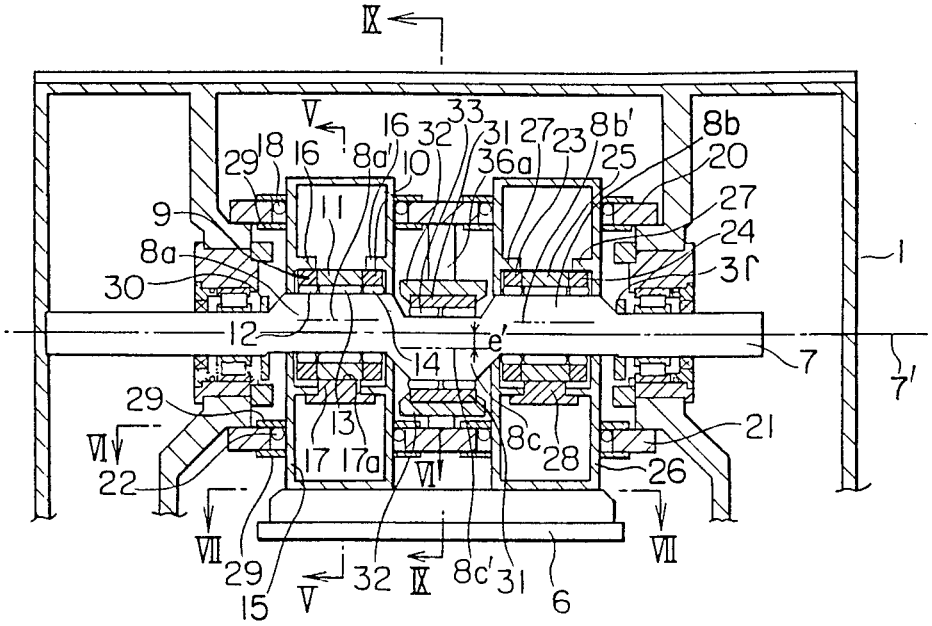
FIG. 4 is a sectional view of a mechanism for vertically moving a slide of the apparatus shown in FIG. 1 in which the slide is in the position of the top dead center.
Figure 5:
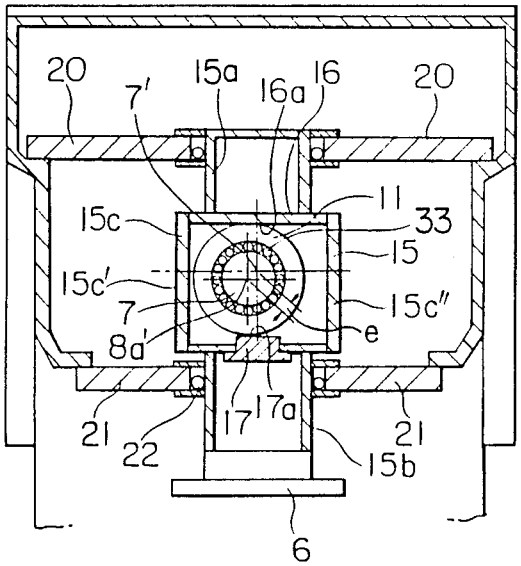
FIG. 5 is a sectional view taken along a line V—V of FIG. 4, the slide being moved slightly downward compared with the state shown in FIG. 4.

As is more clearly illustrated in FIGS. 4 and 5, first, second and third roller followers 9, 10 and 11 are fitted around the crank portion **8*a* with rollers 12, 14 and 13 interposed therebetween and are rotatable about the axis 8*a'* of the crank portion 8*a*. As shown in FIG. 4, these first, second and third roller followers 9, 10 and 11 are disposed parallel with each other in the direction of the axis 8*a'* of the crank portion 8*a* and are respectively placed in positions which correspond to the left end, the right end and an intermediate section of the crank portion 8*a*. The press apparatus is also provided with slide posts each having an upper slide portion 15*a*, a lower slide portion 15b connected at its lower end to the slide 6, and a central portion 15c interposed between these slide portions. The crank shaft 7 passes through the central portion 15c of each slide post 15. In this central portion 15c are disposed (as viewed in FIG. 4) a pair of left and right upper roller pads 16 having pressure-contact surfaces 16a which pressingly contact the top of the first roller follower 9 and the top of the second roller follower 10, and a lower roller pad 17 having a pressure-contact surface 17a which pressingly contacts the lowermost end of the third roller follower 11. Left and right side walls 15c' and 15c'' of the central portion 15c of the slide post 15 are disposed on the left and right hand sides of the first, second and third roller followers (as viewed in FIG. 5**).

Figure 6:
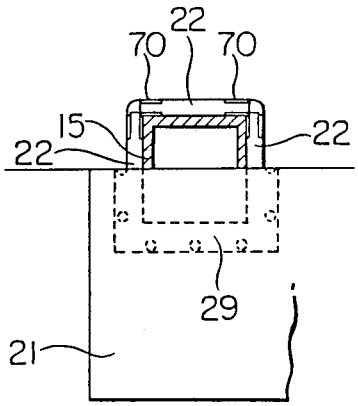
FIG. 6 is an illustration taken along a line VI—VI of FIG. 4.
Figure 7:
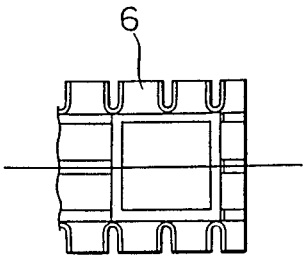
FIG. 7 is an illustration taken along a line VII—VII of FIG. 4.

As is clear from FIGS. 4 to 7, an upper support plate 20 and a lower support plate 21 are fixed to wall portions 19 of the crown 1, and the upper slide portion 15a of the slide post 15 is fitted into the upper support plate 20 with roller bearings 18 interposed therebetween such as to be movable in the vertical direction while the lower slide portion 15b of the slide post 15 is movably fitted into the lower support plate 21 with roller bearings 22 interposed therebetween. Thus, the slide post 15 is supported at two positions, namely, the positions of the upper support plates 20 and the lower support plates 21 such as to be movable in the vertical direction. It is preferable for the slide post 15 in terms of the lateral stiffness to be supported at two positions spaced apart by a comparatively large distance. The entire part of slide post 15 is generally in the form of a hollow quadrangular prism, the sectional configuration of each of the upper slide portion 15a, the central portion 15c and the lower slide portion 15b is a quadrangle such as a square or rectangle. Four side walls of the upper slide portion 15a which form the four sides of the quadrangle are supported by the upper support plate 20. Four roller bearings 18 each of which faces one of the side walls are interposed between the side walls and the upper support plate 20. Similarly, four side walls of the lower slide portion 15b are supported by the lower support plate 21 with four roller bearings 22 interposed therebetween. The form of a hollow quadrangular prism of the slide post 15 is more preferable than a solid cylinder because the former enables the slide post 15 to have reduced weight while being increased in the geometrical moment of inertia to have a greater lateral stiffness. As described above, the roller bearings 18 and 22 are disposed between the upper and lower support plates 20 and 21 and the side walls of the upper and lower slide portions 15a and 15b and are in contact with these portions in a rolling contact manner at a proper contact pressure. This arrangement is preferable because it eliminates the rattle of the slide post 15 when the slide post 15 slides and reduces heat and wear caused by the friction drag, so that the apparatus can be operated smoothly and precisely. In FIGS. 4 and 6, a reference numeral 29 denotes a bearing retaining plate and a reference numeral 70 denotes thin tubes fitted to opposite ends of each roller bearing 22.

The present invention has been described above with respect to the crank portion 8a shown in FIG. 4 at the left hand side and other related constituents involving the first, second and the roller followers 9, 10 and 11, the slide post 15, the upper roller pad 16 and the lower roller pad 17. Also, with respect to the crank portion 8b shown in FIG. 4 at the right hand side, similar members: first, second and third roller followers 23, 24 and 25, a slide post 26, upper roller pad 27, a lower roller pad 28, etc., are provided. The slide post 26 is supported by the upper and lower support plates 20 to be movable in the vertical direction, and the lower end of the slide post 26 is connected to the slide 6, in the same manner as in the case of the slide post 15. The slide posts 15 and 26 thus formed are disposed on the crank shaft 7 and spaced apart along the rotational axis 7', and the slide 6 is fixed to the lower ends of the slide posts 15 and 26. The slide 6 is moved by the slide posts in the vertical direction. By provision of this arrangement, it is possible to further increase the stiffness of the apparatus and the accuracy in the operation.

As is clear from the above description, in the embodiment of the press apparatus shown in the drawings, the axis 8a' of the crank portion 8a effects a circular motion about the axis 7' the radius of which corresponds to the distance e between the axes 7' and 8a', as shown specifically in FIG. 5, when the crank shaft 7 is driven and rotated about the rotational axis 7'. Accordingly, the crank portion 8a, rollers 12, 13 and 14, and the first, second and third roller followers 9, 10 and 11 are moved in one united body to effect the same circular motion as that of the axis 8a' (eccentric circular motion about the axis 7' the radius of which corresponds to the distance e). Therefore, when the crank shaft 7 is rotated clockwisely form the position shown in FIG. 5, the slide post 15 is moved upward in accordance with the above-described eccentric circular motion. As the crank shaft further rotates, the side post 15 starts to move downward. Thus the slide post 15 reciprocatively moves in the vertical direction as the crank shaft rotates continuously. When the slide post 15 moves in this manner, the slide post 26 also moves in the same direction and to the same extent, and the slide 6 is moved in the vertical direction by the slide posts 15 and 26 between the top dead center shown in FIG. 4 and the bottom dead center shown in FIG. 1. The stroke of this movement is 2e.

Since the mechanism in which the slide post 15 is moved in the vertical direction by the first, second and third roller followers 9, 10 and 11 and the mechanism in which the slide post 26 is moved by the first, second and third roller followers 23, 24 and 25 respectively constitute yoke mechanisms, the slide 6 smoothly perform a vertical motion represented by a precise sine curve as the crank shaft 7 rotates continuously. As described above, the first and second roller followers 9 and 10 are pressingly in contact with the upper roller pad 16; and the third roller follower 11, with the lower roller pad 17. Similarly, the roller followers 23 and 24 are pressingly in contact with the upper roller pad 27; and the roller follower 25, with the lower pad 28. Therefore, the slide 6 can be moved precisely in the vertical direction without rattling. The method of incorporating, e.g., the roller followers into the assembly in contact with other members under pressure (in a pressurized state) and the method for adjusting the force of maintaining the pressure-contact state in accordance with the present invention have been well known, and the descriptions related to such methods are omitted.

Figure 8:
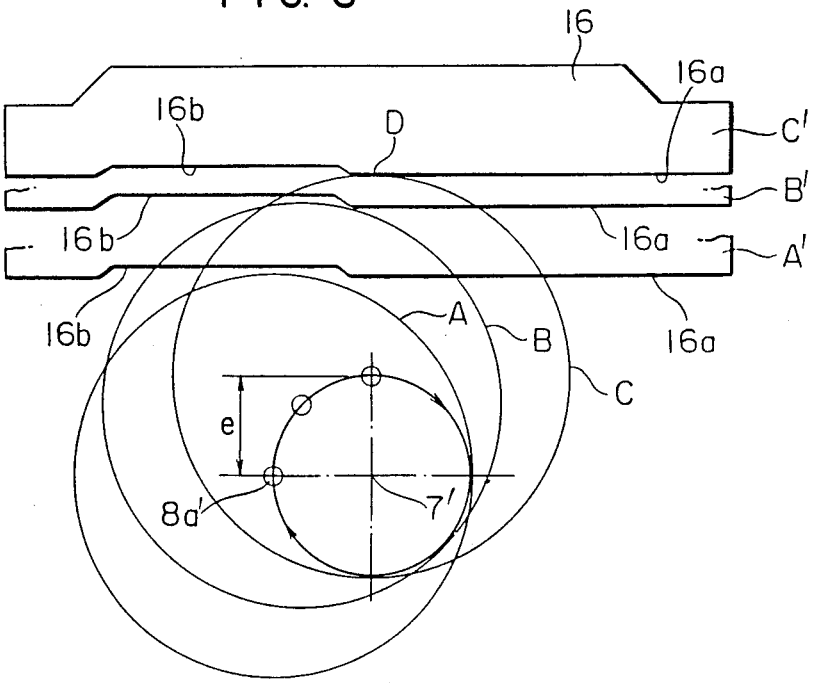
FIG. 8 is an illustration of a modified form of an upper roller pad in the apparatus shown in FIG. 1.

It is preferable to arrange such that, as shown in FIG. 8, the lower surface of the roller pad 16 has the pressure-contact surface 16a and a recessed surface 16b which is adjacent to the pressure-contact surface 16a and which acts as a pressure-release surface which functions to release the upper roller pad 16 and the first and second roller followers 9 and 10 from the pressure-contact state at least at a moment during the period of the upward movement of the slide post 15. That is, as shown in FIG. 8, when the crank shaft 7 rotates about the rotational axis 7', the first and second roller followers 9 and 10 (and the roller follower 11) move as indicated by circles A, B and C, and the slide post 15 and the roller pad 16 integral with the slide post 15 correspondingly move upward as indicated by the lines A', B' and C'. As is apparent form the comparison between the state indicated by A and A' and the state indicated by B and B', the first and second roller followers 9 and 10 are released from the contact with the lower surface of the upper roller pad 16 at least at a moment during the period of the upward movement of the slide post 15. In this state, they are free from the above-described pressure-contact state, so that the first and second roller followers 9 and 10 can freely rotate about the axis 8a' to a certain extent. That is, if the recessed surface 16b is not provided, the upper roller pad 16 is constantly in contact, under pressure, with the first and second roller followers 9 and 10. The first and second roller followers 9 and 10 move about the rotational axis 7' as indicated by the circles A, B and C while the slide post 15 and the upper roller pad 16 are reciprocatively moving in the vertical direction, but the roller followers 9 and 10 scarcely rotate about the axis 8a'. Accordingly, the roller followers 9 and 10 pressingly contact the upper roller pad 16 substantially at the same points (e.g., the points D), and there is a risk of local wear on the outer peripheral surfaces of the roller followers. Therefore, it is preferable, by providing the recessed surface 16b, to release the above-described pressure-contact state at a moment or in the entire period of the upward movement of the slide post 15, thereby rotating the roller followers 9 and 10 about the axis 8a' to a predetermined extent and uniformizing the wear of the entire peripheral surfaces of the roller followers 9 and 10. However, the pressure-contact state is not released during the downward movement of the slide post 15 to effect a precise movement of the slide 6, since, in the period of this movement, the slide 6 is moved downward to perform the press work. This process has been described with respect to the slide post 15 which is disposed on the left hand side as viewed in FIG. 4, but the same would be true with respect to the slide post 26 disposed on the right hand side as viewed in FIG. 4.

In the embodiment shown in the drawings, various dynamic balancers for ensuring the dynamic balance of the apparatus in the operated state are provided in order to minimize problems caused in response to the speed of the operation such as vibrations, noise and inaccuracy and ensure a stable operation over the entire speed range. They will be described below with reference to FIGS. 4 and 9.

As described above, the crank shaft 7 is provided with (as viewed in FIG. 4) the left and right crank portions 8a and 8b with the axes 8a' and 8b' spaced apart from the rotational axis 7' by the distance e, and the central crank portion 8c with the axis 8c' spaced apart from the axis 7' by the distance e' in the opposite direction relative to the axes 8a' and 8b'. In order to maintain the dynamic balance of the crank shaft 7 when the same is rotated, crank shaft dynamic balancers 30 and 30' (shown in FIG. 4) consisting of weights having proper masses are disposed outside the left and right crank portions 8a and 8b. These dynamic balancers may be of a well known type.

Figure 9:
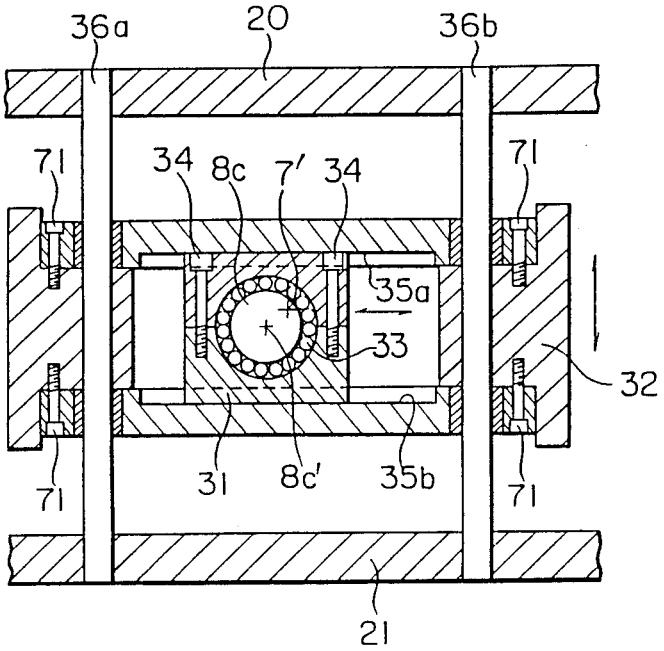
FIG. 9 is an illustration of a dynamic balancer for roller followers and for a slide and die.

As described, above, the crank portions 8a and 8b are provided with three roller followers 9, 10 and 11, and the other three roller followers 23, 24 and 25 which can effect the eccentric rotary motion, and the slide posts 15 and 26 and upper die connected to these posts are adapted to perform the vertical motion. In order to keep the dynamic balance of these members during the operation of the apparatus, a dynamic balancer 31 for the roller followers and a dynamic balancer 32 for the slide and die are disposed on the central crank portion 8c located at the center as viewed in FIG. 4. The dynamic balancer 31 for the roller followers is relatively rotatably fitted to the crank portion 8c with roller bearings 33 interposed therebetween, as shown in FIG. 9. The dynamic balancer 31 whose outer peripheral surface forms a general rectangular transverse sectional configuration is slidable in the dynamic balancer 32 for the upper die along the upper and lower slide surfaces 35a and 35b thereof in the horizontal direction perpendicular to the rotational axis 7', as viewed in FIG. 9. The dynamic balancer 32 is slidable together with the dynamic balancer 31 along a pair of left and right slide posts 36a and 36b which are respectively fixed at their upper and lower ends to the upper and lower support plates 20 and 21, as viewed in FIG. 9. When the crank shaft 7 rotates to generate eccentric motion, namely, the circular motion of the axis 8c' about the axis 7', the dynamic balancer 31 slides leftwardly or rightwardly as viewed in FIG. 9, and the dynamic balancer 32 slides together with the dynamic balancer 31 along the slide posts 36a and 36b in the vertical direction. Accordingly, the dynamic balancer 31 effects the eccentric rotary motion which is generally in symmetrical relationship with the motion of the roller followers 9, 10, 11, 23, 24 and 25. If the mass $W_1$ of the dynamic balancer 31 is set to be $$W_1 = Wa \times \frac{e}{e'}$$

where Wa represents the sum of the masses of these roller followers; e' represents the distance between the axes 7' and 8c' (the eccentricity of the crank portion 8c); and e represents the distance between the axes 7' and 8a' and between the axes 7' and 8b' (the eccentricity of the crank portions 8a and 8b), the dynamic balance relative to the motion of the roller followers can be maintained.

On the other hand, the dynamic balancer 32 effects the vertical motion in the direction reverse to that of the slide posts 15 and 26, the slide 6 and the upper die. If the mass $W_2$ of the dynamic balancer 32 is set to be $$W_2 = Wb \times \frac{e}{e'}$$

where Wb represents the sum of the masses of the slide posts, the slides and the upper die, the dynamic balance relative to the motion of the slide posts, the slides and the upper die can be maintained.

As shown in FIG. 9, the balancer 31 is constituted by separate members: a part indicated above the crank portion 8c; and a part indicated under the same. These members are integrally connected by means of screws 34. The balancer 32 is constituted by an H-shaped member and members for forming the slide surfaces 35a and 35b. These members are connected to each other by means of screws 71.

As described above, in the embodiment shown in the drawings, the three types of dynamic balancers 30, 30'; 31; and 32 are provided, thereby ensuring substantially perfect dynamic balance during the process of pressing operation.

The embodiment shown in the drawings is also, provided with a mechanism for adjusting the shut height (H) (shown in FIG. 1), namely, the height of the slide 6 from the upper surface of the bolster plate 5 to the slide 6 when slide 6 is in the position of the bottom dead center. This mechanism will be described below with reference to FIGS. 1, 2, 3 and 10.

Figure 3:
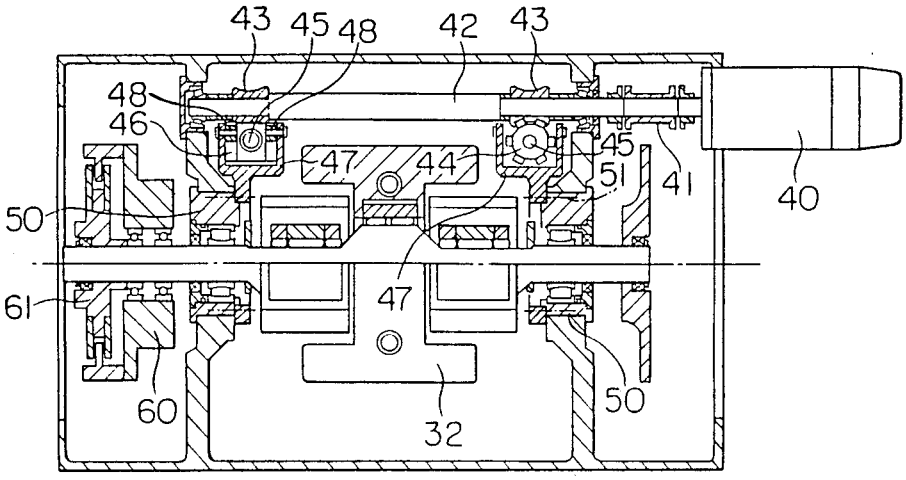
FIG. 3 is a top view of the apparatus shown in FIG. 1.

As shown in FIGS. 1 to 3, cams 43 (roller gear cam for uniform rotation) are disposed on and fitted to a rotational shaft 42 in the vicinity of the opposite ends in the axial direction. The rotational shaft 42 is driven and rotated by a servomotor 40 through a coupling 41. Cam followers protrusively formed on the peripheries of turrets 44 are respectively engaged with the cams 43. The turrets 44 are fitted to the top ends of screw shaft 45, as shown in FIG. 2. The cam 43 and the turret 44 constitute a known type of roller gear cam assembly in which the turret 44 is rotated in one direction to an extent corresponding to the contour of the cam surface of the cam 43 when the rotational shaft 42 rotates together with the cam 43. Each screw shaft 45 is screwed into a movable block 46 which has a substantially rectangular transverse sectional configuration. The movable block 46 is moved along the screw shaft 45 in the vertical direction, as viewed in FIG. 2, when the screw shaft 45 rotates together with the turret 44. The screw portions of the screw shaft 45 and the movable block 46 may be in the form of frictionless ball screws. Grooves 46′ are formed in the surface of one wall of the movable block 46 and the opposite outside surface of a wall portion which faces in the direction reverse to that of the picture plane of FIG. 2, and the surface of the opposite wall portion facing in the direction of the picture plane. A pair of cam followers 48 which are rotatably set at the top of a shut height adjusting arm 47 are movably engaged with these grooves 46′. That is, as shown on the upper left hand side in FIG. 3, the right end of the arm 47 shown in FIG. 2 branches into two portions, and the cam followers 48 which engage with the grooves 46′ are respectively disposed on the walls of these branching portions.

The other end (the left end, as viewed in FIG. 2) of the arm 47 is connected, by means of a screws 51, to an eccentric flange 50 which has an outside diametral portion engaged with the wall portion 19 of the crown 1 and an inside diametral portion fitted to the crank shaft 7 with a bearing 49 interposed therebetween. The eccentric flange 50 itself is of a known type, and the center axis of the inside diametral portion corresponds to the axis 7′ of the crank shaft 7 while the center axis of the outside diametral portion is shifted from the rotational axis 7′ at an eccentricity of $e_1$. Accordingly, when this eccentric flange 50 rotates in the wall portions 19 about the center axis of the portion of the outer diameter, the position of the rotational axis 7′, namely, the position of the crank shaft 7 is moved in the vertical direction, thereby adjusting the shut height H.

As is clear from the above description, when the servomotor 40 is driven to rotate the shaft 42, the screw shaft 45 is rotated through the cam 43 and turret 44; the movable block 46 is moved in the vertical direction as viewed in FIG. 2; and the arm 47 correspondingly pivots to rotate the eccentric flange 50, thereby adjusting the shut height H.

Figure 10:
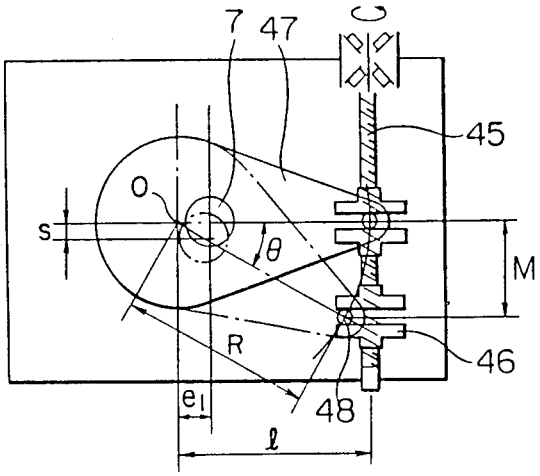
FIG. 10 is an illustration of a mechanism for adjusting the shut height.

It is assumed here that, as shown in FIG. 10, the distance between the center o of the pivotal movement of the arm 47 and the cam follower 48 is R; the distance between the center o of the pivotal movement and screw shaft 45 is l; the amount of movement of the movable block 46 is M; the angle of pivotal movement of the arm 47 which corresponds to the amount of movement M is $\theta$; and the eccentricity of the eccentric flange 50 is $e_1$. (The eccentricity $e_1$ corresponds to the distance between the center o of the pivotal movement and the central axis of the crank shaft 7, since the eccentric flange 50 rotates about the center o of the pivotal movement.) The slide 6 and the crank shaft 7 constitute a yoke mechanism, so that the relationship between the amount of movement M and the amount of corresponding vertical movement S of the crank shaft 7 is represented by equations:

$$S = e_1 \cdot \sin\theta,\ M = R \cdot \sin\theta \tag{1}$$

$$\frac{S}{M} = \frac{e_1 \cdot \sin\theta}{R \cdot \sin\theta} \tag{2}$$

$$S = M\frac{e_1}{R} \tag{3}$$

since $e_1/R$ is constant, $$S = KM\ (K \text{ is a constant of proportion}) \tag{4}$$

Thus, S is in proportion to M, so that S, namely, the amount of vertical movement of the crank shaft 7 (or the amount of vertical movement of the slide 6) is easily determined from the angle of rotation of the screw shaft 45, thereby facilitating the numerical control, etc., of the amount of movement of the slide 6.

in FIGS. 1 and 3, reference numerals 60, 61 and 62 respectively denote a driving pulley, a clutch and a brake.

The clutch 61, the brake 62, etc., are the same types as those ordinarily used in this type of apparatus for the purpose of discontinuing the crank shaft 7 as desired without turning off the drive power source.

As is clear from the above description, in the press apparatus in accordance with the present invention, the mechanism for vertically moving the slide posts constitutes a yoke mechanism so that the movement of each slide post is suitably effected such as to be represented by a precise sine curve; and the slide posts are moved by utilizing the effect of rolling contact between the roller followers and the upper and lower roller pads which are incorporated while being suitably pressurized. The problems of rattling, heat due to friction, etc., are thereby eliminated, and a very high degree of accuracy in the operation is realized.

What is claimed is:

1. A press having an input crank shaft, a slide operatively connected to said input crank shaft to move said slide vertically upon rotational or vertical movement of said input crank shaft, and shut height adjusting means, wherein said shut height adjusting means comprises:

(a) a motor-driven, substantially horizontal rotational shaft supported within said press;

(b) a plurality of roller gear cams disposed on said rotational shaft;

(c) a plurality of substantially vertical screw shafts mounted within said press, each of said screw shafts having a first threaded end portion and a second end portion;

(d) an individual turret mounted at said second end portion of each of said screw shafts;

(e) a plurality of cam followers mounted on each of said turrets for engaging said roller gear cams;

(f) an individual vertically-movable block threadably engaging the first threaded end portion of each of said screw shafts;

(g) an arm having first and second end portions, said first end portion being operatively connected to said vertically movable block;

(h) an eccentric flange rotatably mounted at said second end portion of said arm and operatively connected to said input crank shaft, whereby vertical movement of said movable block pivots said arm to rotate said eccentric flange and provide vertical movement to said input crank shaft and thereby adjust the shut height of said press.

2. A press having a frame, an input crank shaft mounted in said frame, a slide supported in said frame, horizontally non-adjustable slide post means supported in said frame and operatively interconnecting said slide and said input crank shaft such that rotational movement of said input crank shaft moves said slide post means and said slide vertically, said slide post means and said slide further being adjustable vertically together with said crank shaft when said input crank shaft is vertically adjusted;

an adjusting mechanism for vertically adjusting said input crank shaft comprising an eccentric flange rotatably mounted within said frame and eccentrically supporting said crank shaft, and an arm having first and second end portions, said second end portion being secured to said flange, and said first end portion being connected to drive means for rotating said eccentric flange, wherein:

the connection between said first end portion of said arm and said drive means comprises a cam follower provided at said first end portion of said arm, a vertically movable block having a groove which engages said cam follower, and a vertically disposed screw shaft rotatably driven by said drive means for vertically adjusting said block; and, the interconnection between said slide post means and said input crank shaft comprises a pressure ring arrangement disposed in said slide post, said pressure ring arrangement comprising a first pressure ring, and second and third pressure rings arranged at the sides of said first pressure ring, and a pressure ring pad arrangement having a lower pressure ring pad having a horizontal pressure-contact surface in pressure contact with said first pressure ring and upper pressure ring pads having pressure contact surfaces for said second and third pressure rings, said pressure ring arrangement being horizontally displaceable with respect to said pressure ring pad arrangement such as to compensate for horizontal movement resulting from rotation of said eccentric flange.

* * * * *